US006163104A

United States Patent [19]

Kimura

[11] Patent Number: 6,163,104

[45] Date of Patent: Dec. 19, 2000

[54] COLOR CATHODE-RAY TUBE

[75] Inventor: Masamichi Kimura, Osaka, Japan

[73] Assignee: Matsushita Electronics Corporation, Osaka, Japan

[21] Appl. No.: 09/291,530

[22] Filed: Apr. 14, 1999

[51] Int. Cl.[7] ..... H01J 29/70

[52] U.S. Cl. ..... 313/421; 313/440; 335/213

[58] Field of Search ..... 313/440, 421, 313/430, 433; 335/210, 213, 299

[56] References Cited

U.S. PATENT DOCUMENTS 5,757,121 5/1998 Nakata ..... 313/440
6,016,093 1/2000 Grubben et al. ..... 313/440 X

FOREIGN PATENT DOCUMENTS 5-234537 9/1993 Japan .

*Primary Examiner*—Ashok Patel

*Attorney, Agent, or Firm*—Merchant & Gould P.C.

[57] ABSTRACT

The color cathode-ray tube comprises a glass bulb, a shadow mask, a deflection yoke, and an electron-beam shifting device. The glass bulb comprises a face-plate with stripe-like phosphors for a plurality of colors formed on its inner face by a printing method, a funnel portion connected to the rear part of the face-plate, and a neck portion formed at the rear of the funnel portion. Inside the neck portion, an inline electron gun is provided for emitting electron beams. The shadow mask comprises a plurality of openings disposed corresponding to the stripe direction of the phosphors for each color on the face-plate. The deflection yoke is provided on the peripheral surfaces of the funnel portion and the neck portion. The electron-beam shifting device is provided on the peripheral surface of the neck portion for shifting the deflection center of the electron beams in the inline-alignment direction of the electron beams. The phosphors are formed by the printing method, thus reducing the costs. Furthermore, the electron-beam shifting device is provided, thus ensuring accurate color reproduction.

3 Claims, 6 Drawing Sheets

COLOR CATHODE-RAY TUBE

FIELD OF THE INVENTION

The present invention relates to a color cathode-ray tube used in television receivers, information processors, or the like.

BACKGROUND OF THE INVENTION

A conventional color cathode-ray tube comprises a glass bulb, a shadow mask, and a deflection yoke. The glass bulb comprises a face-plate with stripe-like phosphors for red, green and blue on its inner face, a funnel portion connected to the rear part of the face-plate, and a neck portion formed at the rear of the funnel portion. Inside the neck portion, an inline electron gun for emitting electron beams is provided. The shadow mask has a plurality of openings disposed corresponding to the stripe direction of the phosphors for each color on the face-plate. The deflection yoke is provided on the peripheral surfaces of the funnel portion and the neck portion.

In a process of manufacturing a color cathode-ray lube for ensuring color reproduction, a face-plate and a shadow mask are considered as a pair of components, and phosphors for red, green, and blue are formed on the face-plate by three sequential steps of: applying phosphors onto the face-plate; attaching the shadow mask onto the face-plate and exposing the face-plate through openings of the shadow mask; and detaching the shadow mask from the face-plate, which is then developed.

In a process of manufacturing a color cathode-ray tube for reducing manufacturing cost, the face-plate and the shadow mask are considered as separate components, and phosphors for red, green, and blue are formed on the face-plate by a screen printing method without using a shadow mask.

However, in the conventional color-cathode ray tube, the former manufacturing process requires three steps of the application, exposure, and development in addition to the attachment and detachment of the shadow mask onto and from the face-plate in forming the phosphors for each color as described above. Therefore, complex manufacturing equipment and a long manufacturing time are required, thus increasing the cost of the color cathode-ray tube. On the other hand, in the latter manufacturing process, when a shadow mask is attached onto a face-plate, the attachment error of the shadow mask to the face-plate, particularly the attachment error that occurs when the stripe-like openings of the shadow mask tilt with respect to the stripe direction of the phosphors, cannot be corrected, thus causing unevenness in color. In addition, the color reproduction cannot be ensured easily due to insufficient beam landing tolerance.

SUMMARY OF THE INVENTION

The present invention aims to solve such problems. The present invention ensures color reproduction and provides an inexpensive color cathode-ray tube manufactured by a simplified process of forming phosphors for each color.

The color cathode-ray tube of the present invention comprises a glass bulb, a shadow mask, a deflection yoke, and an electron-beam shifting device. The glass bulb comprises a face-plate with stripe-like phosphors for a plurality of colors formed on its inner face by a printing method, a funnel portion connected to the rear part of the face-plate, and a neck portion formed at the rear of the funnel portion. Inside the neck portion, an inline electron gun is provided for emitting electron beams. The shadow mask comprises a plurality of openings disposed corresponding to the stripe direction of the phosphors for each color on the face-plate. The deflection yoke is provided on the peripheral surfaces of the funnel portion and the neck portion. The electron-beam shifting device is provided on the peripheral surface of the neck portion for shifting the deflection center of electron beams in the inline-alignment direction of the electron beams.

The aforementioned configuration does not require the attachment and detachment of a shadow mask in forming the phosphors and thus simplifies the process of forming the phosphors for a plurality of colors on the inner face of the face-plate. Furthermore, even if the stripe-like openings of the shadow mask tilt with respect to the stripe direction of the phosphors, the electron-beam shifting device can shift the deflection center of electron beams corresponding to the tilt direction.

DETAILED DESCRIPTION OF THE INVENTION

An embodiment of the present invention will be explained with reference to the drawings as follows.

Figure 1:
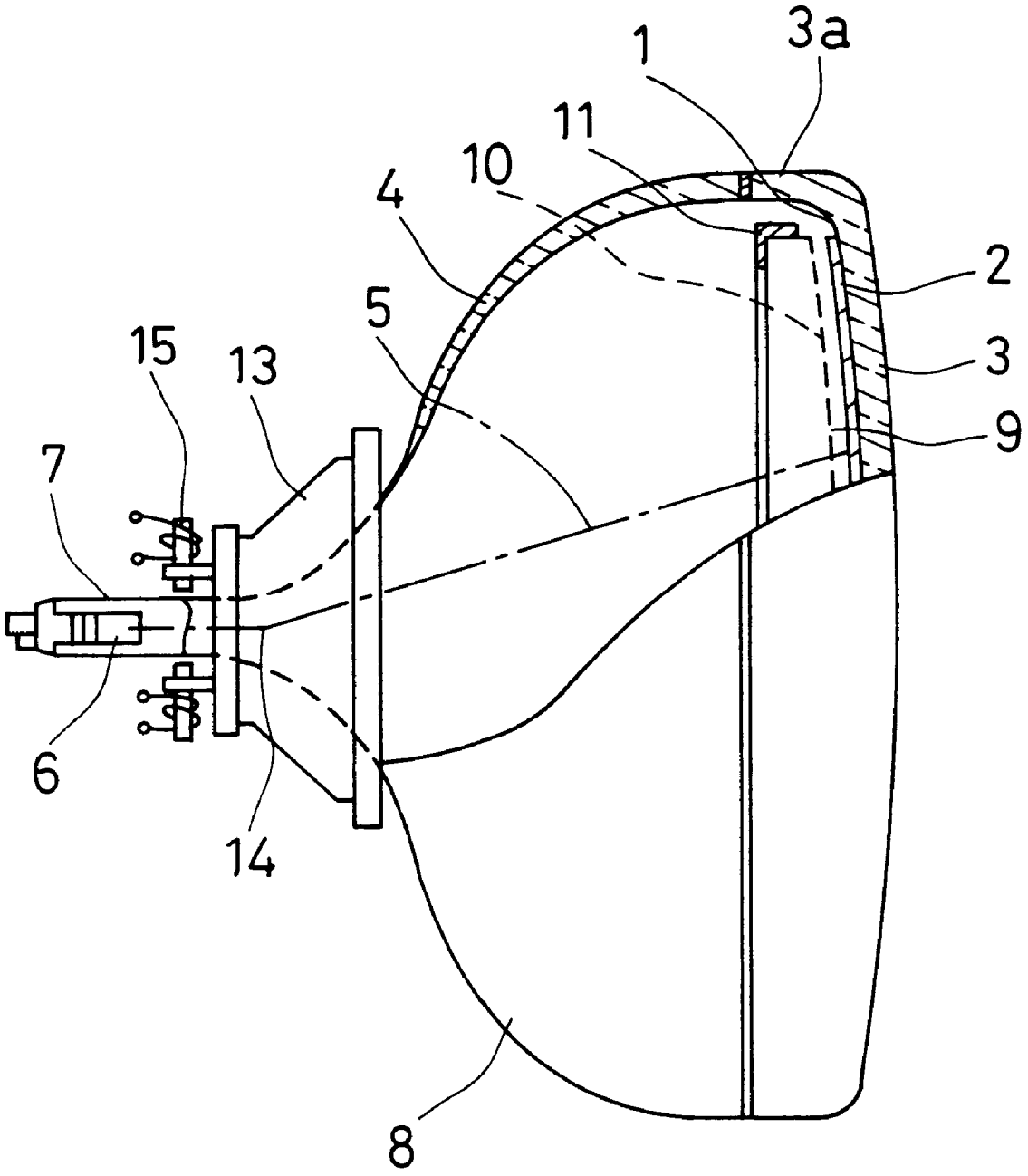
FIG. 1 is a partially cutaway side view of the main portion of a color cathode-ray tube of an embodiment according to the present invention.
Figure 2:
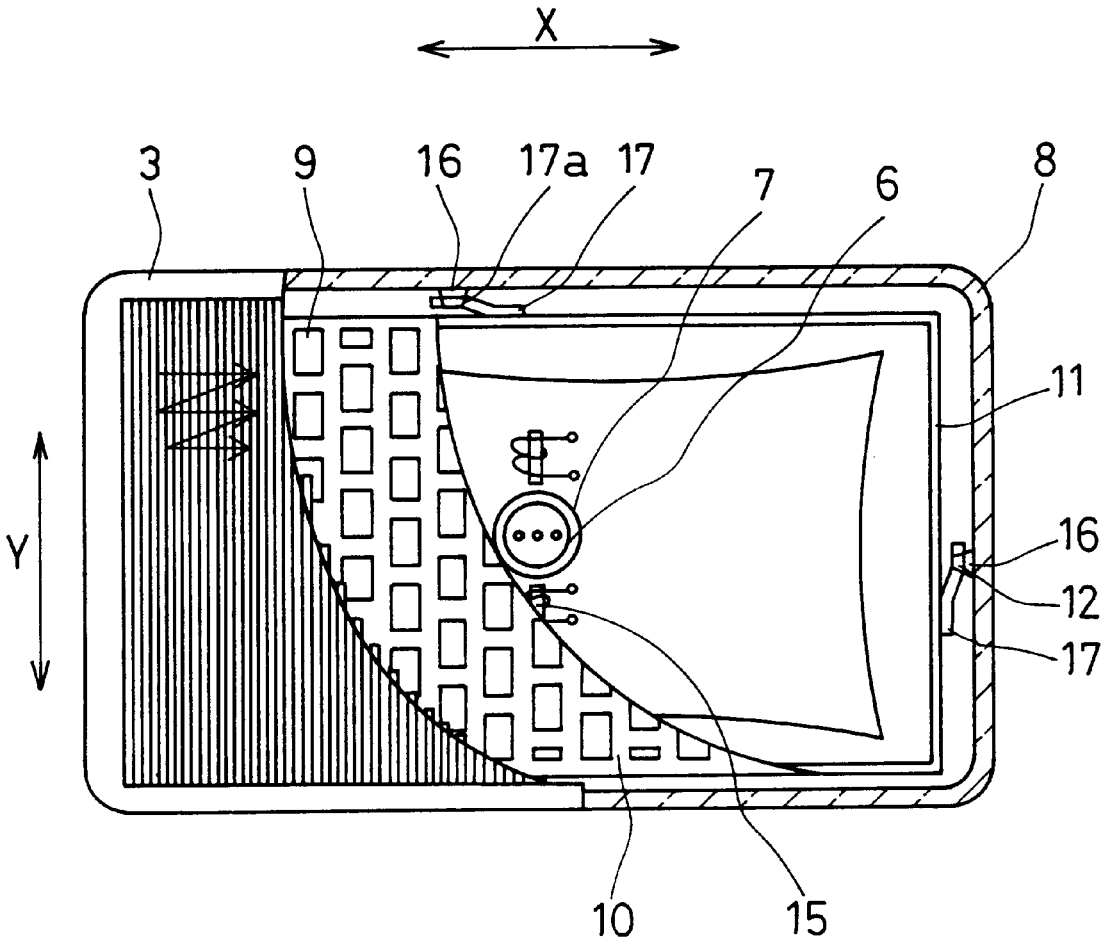
FIG. 2 is a partially cutaway plan view of the main portion of the color cathode-ray tube of the embodiment according to the present invention.

As shown in FIGS. 1 and 2, a color cathode-ray tube of the embodiment according to the present invention comprises a glass bulb 8, a shadow mask 10, a mask frame 11 for supporting the shadow mask 10, a supporting member 12, a deflection yoke 13, and an electrcon-beam shifting device 15. The glass bulb 8 comprises a face-plate 3 with stripe-like phosphors 2 for a plurality of colors formed on its inner face 1 by a printing method, a funnel portion 4 connected to the rear part of the face-plate 3, and a neck portion 7 formed at the rear of the funnel portion 4. Inside the neck portion 7, an inline electron gun 6 is provided for emitting an electron beam 5. The shadow mask 10 comprises a plurality of substantially rectangular openings 9 disposed corresponding to the stripe direction Y of the phosphors 2 for each color on the face-plate 3. The supporting member 12 supports the mask frame 11 so as to be fixed to the glass bulb 8 with a surface of the shadow mask 10 being adjacent to the inner face of the face-plate 3. The deflection yoke 13 is provided on the peripheral surfaces of the funnel portion 4 and the neck portion 7. The electron-beam shifting device 15 is provided on the peripheral surface of the neck portion 7 for shifting the deflection center 14 of the electron beam 5 in the inline-alignment direction X of the electron beam 5.

The stripe-like phosphors 2 for a plurality of colors on the inner face 1 of the face-plate 3, for example, phosphors for red, green, and blue, are formed by a screen printing method without using the shadow mask 10. The screen printing method comprises the following steps that are not shown in the figures. A screen mask with openings, a squeegee, and phosphor pastes to be applied on the inner face 1 of the face-plate 3 corresponding to the phosphors 2 for each color are prepared. Then, for example, when forming phosphors 2 for red on the inner face 1 of the face-plate 3, the screen mask and a red phosphor paste are arranged sequentially on the inner face 1 of the face-plate 3. The movement of the squeegee on the screen mask allows the red phosphor paste to be applied on the inner face 1 of the face-plate 3 through the openings of the screen mask. By the same method, green and blue phosphor pastes are applied sequentially to form respective phosphors. Then, a baking process follows. In order to carry out the screen printing method easily, the face-plate 3 may have a flat surface on which the phosphors 2 are formed or a shorter wall portion 3*a*.

As shown in FIG. 2, the supporting member 12 comprises, for example, four studs 16 (in the four side faces of the glass bulb 8) and four spring plates 17. Each stud 16 is fixed to the inner face of a side-wall portion of the glass bulb 8. In each spring plate 17, one end is welded to the side-wall outer face of the mask frame 11 and the other end has a hole 17*a* to be engaged with the stud 16.

Figure 3:
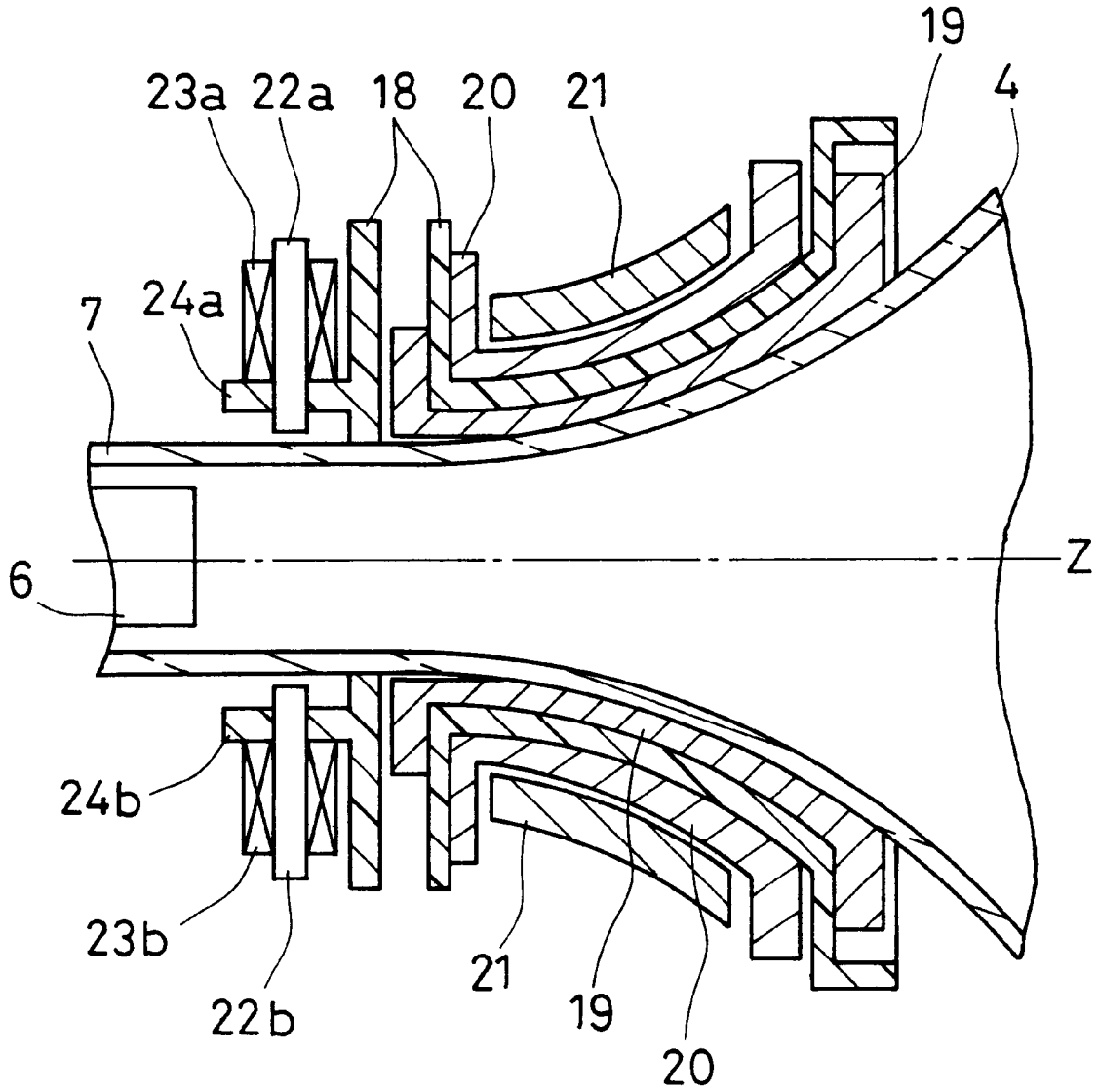
FIG. 3 is a cross-sectional view of the main portion of a deflection yoke in the color cathode-ray tube of the embodiment according to the present invention.

As shown in FIG. 3, a saddle-type horizontal deflection coil 19 and a saddle-type vertical deflection coil 20 are incorporated in the deflection yoke 13. The horizontal deflection coil 19 for generating a pincushion magnetic field is positioned inside supporting frames 18 made of heat-resistant insulating resin. The vertical deflection coil 20 for generating a barrel magnetic field is positioned outside the supporting frames 18. In the deflection yoke 13, a ferrite core 21 for increasing magnetic flux is attached on the circumference of the vertical deflection coil 20.

As shown in FIG. 3, the electron-beam shifting device 15 comprises a pair of coils 23*a* and 23*b* generating a magnetic field that are wound around, for example, I-shaped iron cores 22*a* and 22*b* respectively, and a correction circuit (not shown in the figure) controlling the current applied to the pair of coils 23*a* and 23*b* in one field on a screen. The pair of coils 23*a* and 23*b* are arranged symmetrically with respect to a tube axis Z and the inline-alignment direction X(see FIG. 2) of the electron beam 5 with the neck portion 7 sandwiched. Further, the pair of coils 23*a* and 23*b* are arranged at the electron-gun 6 side at the rear of the deflection yoke 13, and, for example, are supported together with the iron cores 22*a* and 22*b* by coil supporting plates 24*a* and 24*b* of the supporting frames 18.

Figure 4:
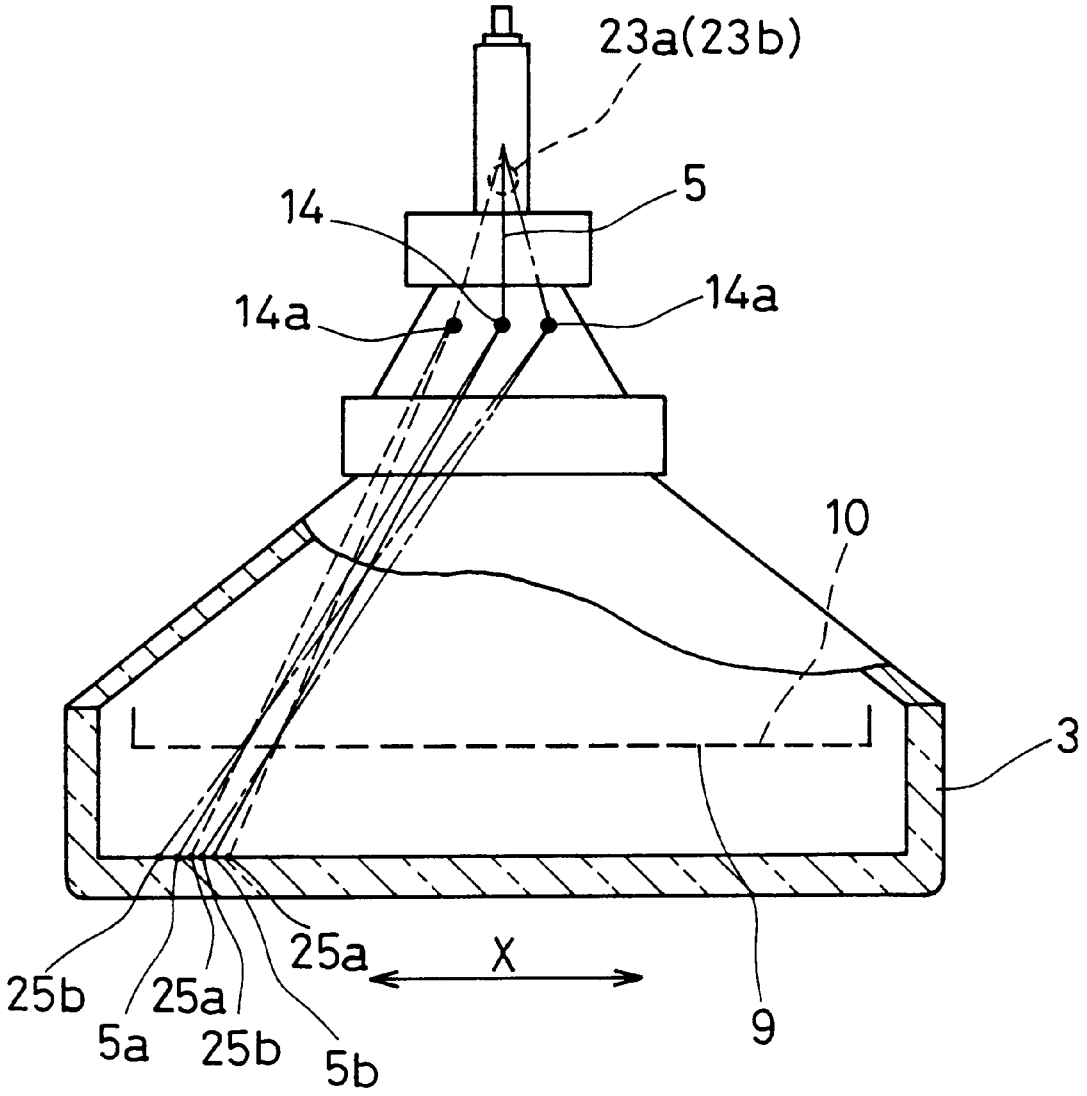
FIG. 4 is a conceptual view showing electron-beam shift by an electron-beam shifting device in the color cathode-ray tube of the embodiment according to the present invention.

The aforementioned correction circuit applies current to the pair of coils 23*a* and 23*b* to generate a magnetic field in the direction (Y) orthogonal to the inline-alignment direction X. Depending on the current amount, to which the magnetic field strength is proportional, the deflection center 14 of the electron beam 5 is shifted freely in the inline-alignment direction X to control the electron beam 5. That is to say, as shown in FIG. 4, the correction circuit controls an electron beam 5*a* that has passed through an opening 9 of the shadow mask 10 and has reached the face-plate 3 so as to shift to the position 25*a* upon the shift of the deflection center 14 to the position 14*a* and to the position 25*b* upon the shift of the deflection center 14 to the position 14*b*.

Figure 5:
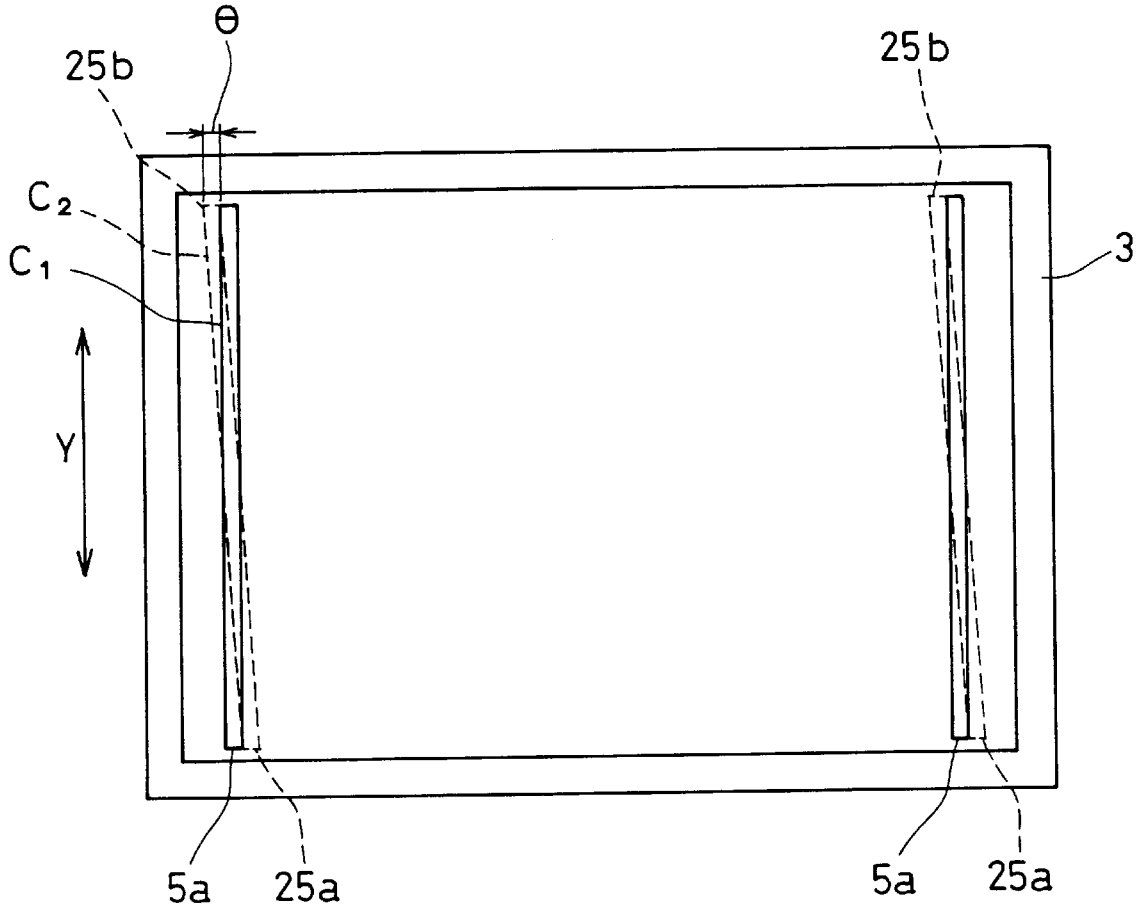
FIG. 5 is a view showing a display screen when an attachment error of the shadow mask occurs in the color cathode-ray tube of the embodiment according to the present invention.
Figure 6:
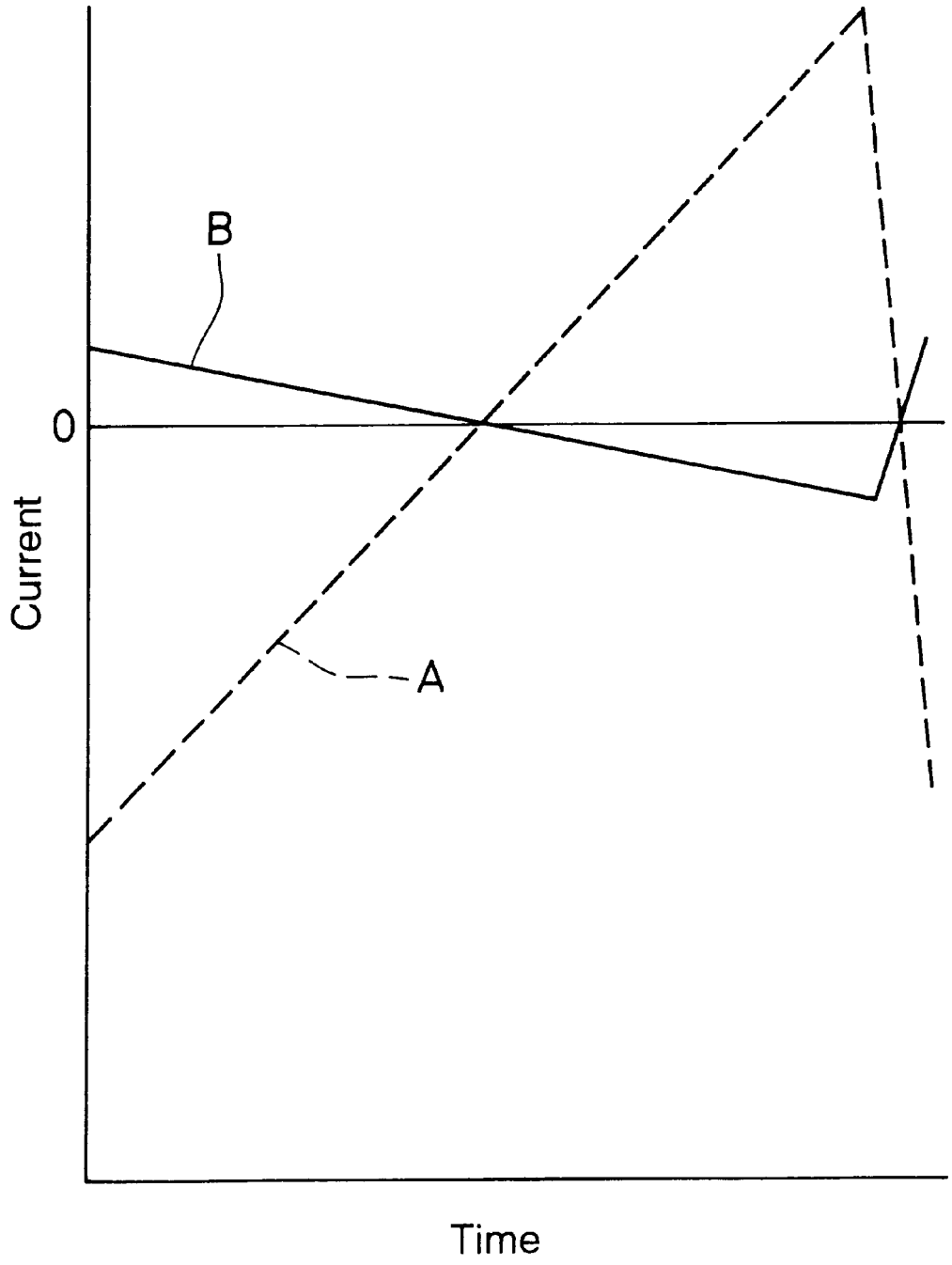
FIG. 6 shows a waveform in an example of a vertical deflection current of a vertical deflection coil and a controlling current of a controlling circuit in the electron-beam shifting device in the color cathode-ray tube of the embodiment according to the present invention.

For instance, suppose when a complete shadow mask 10 was attached to a complete face plate 3 having stripe-like phosphors 2 for a plurality of colors, an attachment error of the shadow mask 10 to the face-plate 3 occurred. As shown in FIG. 5, when a normal screen display shown with an unbroken line C1 (display in the stripe direction Y of the phosphor 2) is changed to a screen display shown with a broken line $C_2$(display with a tilt of θ degrees), the electron beam 5*a* is shifted to the position 25*b* in the upper half of the screen. Therefore, the deflection center 14 is shifted to the 14*a* side. On the other hand, in the lower half of the screen, since the electron beam 5*a* is shifted to the position 25*a*, the deflection center 14 is shifted to the 14*b* side. Thus, the current of the correction circuit is controlled so that the screen display shown with the broken line with a tilt of θ degrees is corrected to the normal screen display shown with the unbroken line. In this example, as shown in FIG. 6, the correction circuit controls a current B applied to the pair of coils 23*a* and 23*b* so as to be proportional to a vertical deflection current A (a current applied to the vertical deflection coil 20) of the electron beam 5 in one field.

The effects of the above-mentioned color cathode-ray tube will be explained as follows.

As shown in FIG. 1, in the embodiment of the present invention, the stripe-like phosphors 2 for red, green, and blue are formed on the inner face of the face-plate 3 by a printing method. Therefore, in forming the phosphors for each color, the shadow mask 10 is not required to be attached to or detached from the face-plate 3, thus simplifying the process of forming the phosphors. As a result, the costs of the color cathode-ray tube can be reduced.

Even if the attachment error occurs when a complete shadow mask 10 is attached to a complete face-plate 3 on which the phosphors 2 have been formed by a printing method, for example, the attachment error in which the stripe-like openings of the shadow mask 10 are tilted by θ degrees with respect to the stripe direction of the phosphors 2 as shown, for instance, in FIG. 5 occurs, the electron-beam shifting device 15 shifts the deflection center 14 of the electron beam 5 in the inline-alignment direction X corresponding to the tilt direction, thus irradiating the electron beam 5 onto a predetermined phosphor 2. As a result, the landing tolerance of the electron beam 5 increases and the ratio in which the electron beam 5 strikes phosphors for other colors is decreased, thus ensuring the color reproduction. Furthermore, the aforementioned effects can be obtained even without considering the matching between the complete face-plate 3 and shadow mask 10.

Since the pair of coils 23*a* and 23*b* for generating a magnetic field as the electron-beam shifting device 15 are provided at the electron gun 6 side at the rear of the deflection yoke 13, the deflection center 14 of the electron beam 5 can be shifted to the position 14*a* with a weak magnetic field generated by the pair of coils 23*a* and 23*b*. Therefore, the power consumption by the pair of coils 23*a* and 23*b* can be reduced.

In the aforementioned embodiment, the stripe-like phosphors 2 for a plurality of colors are formed on the inner face 1 of the face-plate 3 by a screen printing method. However, the method is not limited to the screen printing method. The same effects can be obtained by an offset printing method, a printing method in which phosphor pastes for respective colors are sprayed directly onto the inner face 1 of the face-plate 3 by an ink-jet method, a transfer method of transferring phosphors printed on a resin substrate, or the like. Further, in the aforementioned embodiment, the electron-beam shifting device 15 used comprises the pair of coils 23*a* and 23*b* generating a magnetic field that are wound around, for example, the I-shaped iron cores 22*a* and 22*b* respectively, and are arranged opposing each other and sandwiching the neck portion 7. However, the electron-beam shifting device 15 is not limited to that. Even if the electron-beam shifting device 15 comprises the pair of coils 23*a* and 23*b* generating a magnetic field that are not wound around the I-shaped iron cores 22*a* and 22*b*, the same effects can be obtained as long as the deflection center 14 of the electron beam 5 can be shifted to the position 14*a* or 14*b* by the pair of coils 23*a* and 23*b*.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A color cathode-ray tube comprising:

a glass bulb comprising a face-plate with stripe-like phosphors for a plurality of colors formed on its inner face by a printing method, a funnel portion connected to a rear part of the face-plate, and a neck portion formed at a rear of the funnel portion having an inline electron gun provided in its interior for emitting electron beams;

a shadow mask having a plurality of openings disposed corresponding to a stripe direction of the phosphors for each color on the face-plate;

a deflection yoke provided on peripheral surfaces of the funnel portion and the neck portion; and an electron-beam shifting device provided on a peripheral surface of the neck portion for shifting deflection center of the electron beams in an inline-alignment direction of the electron beams.

2. The color cathode-ray tube according to claim 1, wherein as the electron-beam shifting device, a pair of coils generating a magnetic field are arranged symmetrically with respect to a tube axis and the inline-alignment direction of the electron beams with the neck portion sandwiched.

3. The color cathode-ray tube according to claim 2, wherein the pair of coils for generating a magnetic field are provided at an electron gun side at a rear of the deflection yoke.

* * * * *